United States Patent [19]

Lefebvre et al.

[11] 3,985,925

[45] Oct. 12, 1976

[54] COMPOSITE FLOOR COVERINGS

[75] Inventors: Michel S. M. Lefebvre; Joseph Davidovits, both of Saint-Quentin, France

[73] Assignee: Omnium de Prospective Industrielle, San-Quentin, France

[22] Filed: Mar. 25, 1975

[21] Appl. No.: 561,699

Related U.S. Application Data

[63] Continuation of Ser. No. 432,414, Jan. 10, 1974, abandoned, which is a continuation of Ser. No. 199,358, Nov. 16, 1971, abandoned.

[30] Foreign Application Priority Data

Nov. 27, 1970 France ..... 70.42866

[52] U.S. Cl. ..... 428/92; 428/95; 428/218; 428/253; 428/310; 428/311; 428/315

[51] Int. Cl.[2] ..... B32B 7/02

[58] Field of Search ..... 428/92, 95, 253, 218, 428/310, 311, 315

[56] References Cited

UNITED STATES PATENTS

| | | | |
|---|---|---|---|
| 2,358,204 | 9/1944 | Bird | 161/64 |
| 3,269,882 | 8/1966 | Willy | 161/64 |
| 3,705,834 | 12/1972 | Terry | 161/67 |

*Primary Examiner*—Marion E. McCamish
*Attorney, Agent, or Firm*—Brooks, Haidt, Haffner & Delahunty

[57] ABSTRACT

This invention relates to a composite covering, particularly useful as floor covering, constituted by an underlayer of a density varying as a function of the thickness and by a light velvet-type woven fabric with a weight per surface unit of between 70 and 120 g/m$^2$, said fabric, constituting the visible face of the covering, being glued to the underlayer on the side of the zone of high density.

4 Claims, No Drawings

COMPOSITE FLOOR COVERINGS

This is a continuation of application Ser. No. 432,414, filed Jan. 10, 1974, now abandoned, which application was a continuation of application Ser. No. 199,358, filed Nov. 16, 1971, now abandoned.

The present invention relates to a composite covering that may be used in particular as floor covering.

Different types of composite floor coverings are already known such as those constituted by a velvet-type knitted fabric having a weight of 300 to 350 g/m² glued for example to an underlayer made of non-woven fabric or a cellular material by means of agents such as PVC or polyacrylate emulsions. The velvet-type knitted fabric in this case has a double role: on the one hand, it constitutes a good wearing layer; on the other hand the height and density of the velvet ensure the suppleness necessary for comfort. On the contrary, for reasons of resistance to abrasion and wear and tear, the density of velvet must be very high, this fixing a lower limit for the weight per surface unit of this knitted fabric; velvets having a weight lower than 250 g/m² can hardly be used, this making the cost price of the complex very high with respect to the other textile floor coverings.

Dutch published patent application No. 69 02157 discloses a method of covering floors, according to which a woven fabric, then a layer of hard plastics material and finally a layer of soft plastics material are successively disposed on the floor. It is the last soft layer which constitutes the visible face of the covering on which the users may walk.

Now, it has been realised that such coverings do not have a sufficient resistance to abrasion and wear and tear if they are disposed in places where people frequently pass, due in particular to the presence of the soft layer on the upper surface of the covering.

The invention therefore has for its object a new composite covering that may be used in particular as floor covering, and being essentially constituted by an underlayer of density that varies as a function of the thickness, and by a light woven fabric, preferably a velvet-type knitted fabric whose weight is between 70 and 120 g/m², this fabric being glued to the underlayer on the side of the zone of high density and constituting the upper or visible surface of the covering.

Thanks to these arrangements, the drawbacks of known coverings are eliminated. Moreover, the defects that would be met with if a light knitted fabric were used, glued to a felt, a non-woven material or a cellular material of conventional design, i.e. of which the density is constant in the whole thickness of the underlayer, are avoided. As the applicants have realised, these defects are essentially an insufficient resistance to wear and tear and a lack of suppleness of the covering.

On the contrary, in the covering according to the invention, the underlayer has a structure acting as absorbing means, this giving the whole properties of suppleness, resistance to wear and tear, to abrasion and stamping that are absolutely necessary, thus enabling a light woven fabric to be used in all safety for constituting the visible face of the covering.

A few advantageous embodiments of the underlayer and the light woven fabric will now be indicated.

The underlayer may be made of a supple cellular material having in its thickness a gradient of porosity which continuously varies the density.

The zone of highest density will receive the fabric or "wearing" layer, whilst the zone of low density will be in contact with the floor. According to the thickness of the underlayer and the cellular material used, this density may vary for example between 1200 kg/m³ for the zone located below the wear layer and 200 kg/m³ for the zone in contact with the floor.

It is possible to manufacture such an underlayer, but the degree of expansion must be closely checked. It is therefore preferred to manufacture different layers of determined density which will then be connected together to form an assembly whose density varies, no longer continuously but discontinuously, as a function of the thickness. However, an effort will be made to conserve an average density of the underlayer at around 500 to 600 kg/m³.

According to a variant embodiment, the underlayer will be constituted by an expanded synthetic foam, for example polyurethane, the density of which after expansion is 500 kg/m³. However, in order to obtain the sought after result, one of the faces of the foam is rigidified, on which the wear layer will be glued, by incorporating, at the moment of expansion, a weft which will increase the density at this spot.

Expanded PVC may also be used, with a density of 200 to 300 kg/m³. The gradient of density desired is obtained by counter-gluing a sheet of high density PVC at the moment of expansion; in this case, a complex is obtained which has three different density zones, namely: an outer layer on which the wear layer will be glued, the density of which is between 1000 and 1200 kg/m³ according to the material used, a second layer of very small thickness of about 500 kg/m³, resulting from the gluing of the high density layer, and finally the layer of density of 200 to 300 kg/m³.

On this underlayer of variable density, the light woven fabric, for example velvet-type knitted fabric is applied on the high density zone side. Thus a product is obtained which has the mechanical characteristics of suppleness, resistance to wear and tear and to stamping which are conferred by the underlayer with density gradient. The textile layer constituting the outer surface of the floor covering will be made with synthetic fibres procuring a good resistance to abrasion and, moreover, if this textile surface is a brushed knitted fabric, it will be advantageous to break the loops thus formed, this on the one hand improving the resistance to abrasion and on the other hand increasing the length of the pile, giving the whole a character closer to the conventional textile coverings.

In this latter case, it is useful to fix the stitch after the brushing and loop breaking operations. This operation may be effected either at the moment of gluing the knitted fabric to the underlayer, or directly on the reverse side of the knitted fabric with the aid of a finish. Furthermore, the adherence of the knitted fabric to the underlayer will be further increased by using a brushed knitted fabric, the loops of which are broken on the main face and only slightly brushed on the other face.

The light velvet-type knitted fabric may be dyed or printed according to the conventional techniques used in the textile industry. It is however advantageous to effect this finishing operation only once the knitted fabric is glued to one of the elements of the cellular underlayer. In fact, it is possible in this case to use the thermal energy necessary for terminating the cellular expansion in order to ensure the fixing of the dyes or pigments used.

We claim:

1. A composite floor covering article comprising a light woven fabric which constitutes the visible face of the article and a cellular expanded plastic foam underlayer, the underlayer being fixed to the fabric on the first surface of the underlayer and having its highest density at said first surface of the underlayer and a decreasing density through its thickness toward the other surface, the fabric not comprising any portion of the underlayer and the underlayer being constituted by at least two separate and distinct layers of different densities adhered to each other by an adhesive.

2. Covering as claimed in claim 1, wherein the fabric is a knitted fabric made of brushed and loop broken synthetic fibres.

3. Covering as claimed in claim 2, wherein the knitted fabric is coated by a finish before being glued to the underlayer.

4. Covering as claimed in claim 1, wherein the fabric is a velvet-type fabric with a weight per surface unit of between 70 and 120 g/m$^2$.

* * * * *